US007131825B2

(12) United States Patent
Wos

(10) Patent No.: US 7,131,825 B2
(45) Date of Patent: Nov. 7, 2006

(54) SPINDLE-MOTOR DRIVEN PUMP SYSTEM

(75) Inventor: George J Wos, Colton, WA (US)

(73) Assignee: Isothermal Systems Research, Inc., Liberty Lake, WA (US)

( * ) Notice: Subject to any disclaimer, the term of this patent is extended or adjusted under 35 U.S.C. 154(b) by 524 days.

(21) Appl. No.: 10/769,037

(22) Filed: Jan. 30, 2004

(65) Prior Publication Data

US 2005/0168079 A1 Aug. 4, 2005

(51) Int. Cl.
*F04B 17/00* (2006.01)
*F04B 35/04* (2006.01)

(52) U.S. Cl. ..... 417/423.1; 310/52; 310/67 R

(58) Field of Classification Search ..... 417/423.1; 310/52, 67 R
See application file for complete search history.

(56) References Cited

U.S. PATENT DOCUMENTS 1,865,396 A 3/1930 Claypool
1,893,616 A 1/1933 Ferguson
3,658,444 A 4/1972 Rhodes et al.
3,802,804 A 4/1974 Zimmermann
4,101,945 A 7/1978 Butsch
4,403,910 A 9/1983 Watanabe et al.
4,438,542 A 3/1984 Schuh
4,450,472 A 5/1984 Tuckerman et al.
4,633,149 A * 12/1986 Welterlin ..... 318/254
5,006,943 A 4/1991 Elsasser et al.
5,028,218 A 7/1991 Jensen et al.
5,047,677 A 9/1991 Mineta et al.
5,096,390 A 3/1992 Sevrain et al.
5,138,209 A 8/1992 Chuta et al.
5,220,804 A 6/1993 Tilton
5,269,664 A * 12/1993 Buse ..... 417/360
5,443,413 A * 8/1995 Pflager et al. ..... 451/11
5,731,954 A 3/1998 Cheon
5,798,596 A * 8/1998 Lordo ..... 310/261
5,818,131 A * 10/1998 Zhang ..... 310/15
5,942,820 A 8/1999 Yoshida
5,997,261 A * 12/1999 Kershaw et al. ..... 417/366
6,049,149 A * 4/2000 Lin et al. ..... 310/68 R
6,056,518 A * 5/2000 Allen et al. ..... 417/355
6,082,974 A * 7/2000 Takemoto et al. ..... 417/366
6,094,912 A * 8/2000 Williford ..... 60/520
6,139,361 A 10/2000 Przilas et al.
6,211,587 B1 * 4/2001 Enomoto et al. ..... 310/52
6,234,240 B1 5/2001 Cheon
6,247,429 B1 * 6/2001 Hara et al. ..... 123/41.44
6,293,760 B1 9/2001 Pais et al.
6,377,458 B1 4/2002 Morris et al.
6,439,845 B1 * 8/2002 Veres ..... 415/206
6,447,270 B1 9/2002 Schmidt et al.
6,543,781 B1 4/2003 Rehm et al.
6,612,815 B1 9/2003 Pawellek et al.
6,666,672 B1 12/2003 Steffens (Continued)

*Primary Examiner*—William H. Rodriguez
(74) *Attorney, Agent, or Firm*—Paul A. Knight

(57) ABSTRACT

The present invention is a compact pump that is powered by a brushless DC spindle-motor, as used in disk drives and CD-ROM drives. A hard drive type spindle-motor is a brushless DC motor that is highly balanced, very reliable, available at low cost, and is capable of significant rotational speeds. According to the present invention, a spindle-motor is mounted to a pump housing and to an impeller within the housing. The spindle-motor rotates the impeller causing movement of a fluid. Preferably for spray cooling, the pump is a turbine pump.

25 Claims, 6 Drawing Sheets

U.S. PATENT DOCUMENTS 6,672,818 B1 * 1/2004 Terracol et al. ..... 192/84.1
6,688,861 B1 * 2/2004 Wampler ..... 417/423.7
6,873,069 B1 * 3/2005 Odagiri et al. ..... 310/64
2002/0094281 A1 * 7/2002 Khanwilkar et al. ..... 417/356
2005/0023927 A1 * 2/2005 Inayama et al. ..... 310/261
2005/0118044 A1 * 6/2005 Inoue et al. ..... 417/423.7
2005/0214135 A1 * 9/2005 Shibuya et al. ..... 417/357

* cited by examiner

SPINDLE-MOTOR DRIVEN PUMP SYSTEM

STATEMENT REGARDING FEDERALLY SPONSORED RESEARCH OR DEVELOPMENT

This invention was made with Government support under contract #N68335-00-D-0451 awarded by the Defense Microelectronics Activity. The Government has certain rights in this invention.

CROSS REFERENCE TO RELATED APPLICATIONS

None

BACKGROUND

1. Field of the Invention

The present invention relates to a pump driven by a hard drive type brushless direct current (DC) spindle-motor, suitable for use with liquid cooling systems.

2. Description of the Related Art

Liquid cooling is well known in the art of cooling electronics. As air cooling heat sinks continue to be pushed to new performance levels, so has their cost, complexity, and weight. Liquid cooling systems provide advantages over air cooling in terms of heat removal rates, component reliability and package size.

Liquid cooling removes energy from heat generating components through sensible or latent heat gains of a cooling fluid. The cooling fluid is continuously pressurized by a pump and may be delivered to a thermal management block. The cooling fluid may also be dispensed within a globally cooled enclosure. After the cooling fluid is heated by an electronic component to be cooled, the surplus energy of the fluid is removed by a heat exchanger, or condenser. The cooled fluid exits the heat exchanger and is delivered back to the pump, thus forming a closed loop system.

There are many different liquid cooling systems. Although each type of liquid cooling system may have a unique thermal management block, the closed loop cooling systems are likely to share the common need of pressurizing a supply of liquid coolant. For example: U.S. Pat. No. 6,234,240 discloses a single phase closed loop cooling system; a microchannel liquid cooling system is described by U.S. Pat. No. 4,450,472; an exemplary liquid cooling system is described by U.S. Pat. No. 5,220,804 for a two-phase spray cooling system utilizing a thermal management block; and a globally liquid cooled enclosure is described by U.S. Pat. No. 6,139,361. As described by the '804 patent, spray cooling is capable of absorbing high heat fluxes. Nozzles, or preferably atomizers, break up a supply of liquid coolant into numerous droplets that impinge the surface to be cooled. The size, velocity and resulting momentum of the droplets contributes to the ability of the thermal management unit to absorb heat. These characteristics, and thus the overall performance of the thermal management system are impacted by the performance of the pump. To achieve reliable system performance, it is important that the pump deliver accurate performance over a long life cycle. It is known that pumps driven by DC motors can be used with liquid cooling pumps. U.S. Pat. No. 6,447,270 describes a large scale DC brushless motor used for spray cooling. U.S. Pat. No. 6,193,760 describes a highly specialized DC brushless motor system wherein a rotor creates both the pumping and motor force. U.S. Pat. No. 5,731,954 describes a brushless motor mounted within a reservoir casing.

Desirable features of any liquid cooling system are low cost, high reliability and high performance. Optimization of the pump impacts all three features. Thus, there is a need for a pump that contains a motor with a proven history of high reliability. Thus, there is a need for a pump that contains a motor that can be produced for a low cost. Thus, there is a need for a pump that is compact in size. Furthermore, there is a need for a pump that is efficient in creating its output. Also furthermore, there is a need for a pump that is capable of producing significant pressures.

BRIEF SUMMARY OF THE INVENTION

In order to solve the problems of the prior art, and to provide a highly reliable liquid pump that can produce significant pressures in a compact space for a low cost and with high reliability, a spindle-motor driven pump system has been developed.

The present invention is a compact pump that is powered by a brushless DC spindle-motor, as used in disk drives and CD-ROM drives. A hard drive type spindle-motor is a brushless DC motor that is highly balanced, very reliable, available at low cost, and is capable of significant rotational speeds. According to the present invention, a spindle-motor is mounted to a pump housing and to an impeller within the housing. The spindle-motor rotates the impeller causing movement of a fluid. Preferably for spray cooling, the pump is a turbine pump.

These and other features, aspects, and advantages of the present invention will become better understood with regard to the following description, and accompanying drawings.

BRIEF DESCRIPTION OF THE DRAWINGS

In the course of the detailed description to follow, reference will be made to the attached drawings. These drawings show different aspects of the present invention and, where appropriate, reference numerals illustrating like structures, components, and/or elements in different figures are labeled similarly. It is understood that various combinations of the structures, components, and/or elements other than those specifically shown are contemplated and within the scope of the present invention.

DETAILED DESCRIPTION OF THE PREFERRED EMBODIMENTS

Many of the fastening, connection, manufacturing and other means and components utilized in this invention are widely known and used in the field of the invention are described, and their exact nature or type is not necessary for a person of ordinary skill in the art or science to understand the invention; therefore they will not be discussed in detail.

The terms "a", "an", and "the" as used in the claims herein are used in conformance with long-standing claim drafting practice and not in a limiting way. Unless specifically set forth herein, the terms "a", "an", and "the" are not limited to one of such elements, but instead mean "at least one".

Applicant hereby incorporates by reference U.S. Pat. No. 5,220,804 for a high heat flux evaporative cooling system. Although spray cooling is herein described as the preferred method of liquid cooling, the present invention is not limited to such a thermal management system. The discussion of spray cooling is only provided as a preferred use of the present invention.

Figure 1:
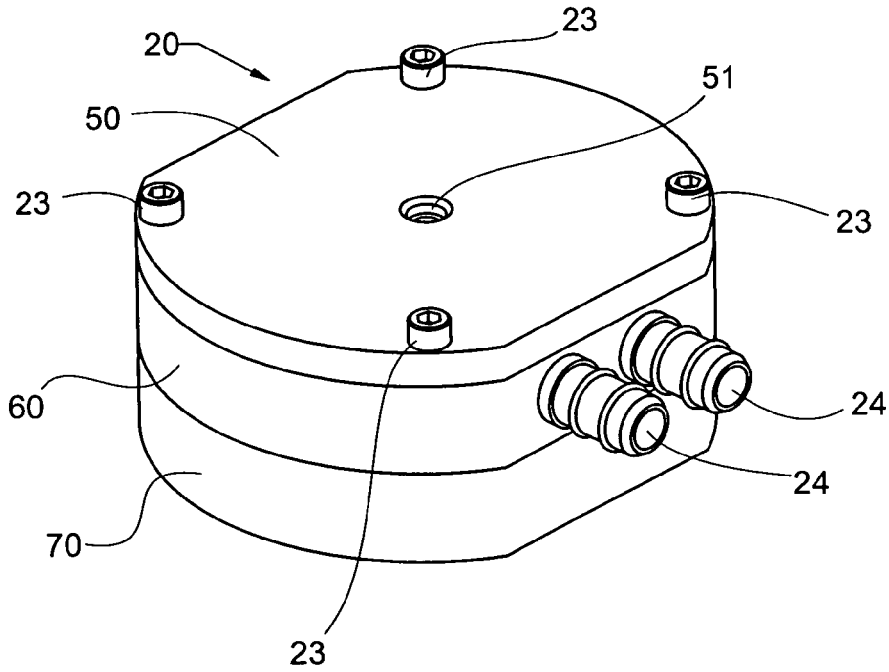
FIG. 1 is a perspective view of a turbine pump according to the present invention.
Figure 2:
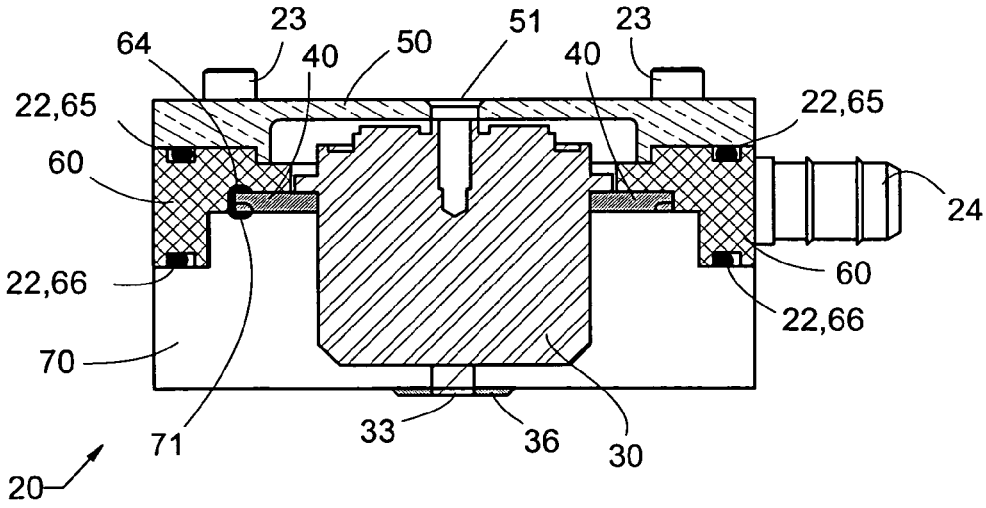
FIG. 2 is a side section view of the pump of FIG. 1 cut through its midplane.

Now referring to FIG. 1, a spindle-motor driven pump system 20 is shown. Although not limited to any particular range, pump system 20 shown and described herein is designed to deliver fluid pressures and flow rates in the range needed to provide liquid cooling of electronic components. Typically, these values are less than 40 pounds per square inch (psi) of pressure and around 500 milliliters per minute (ml/min) of flow per component to be cooled. These ranges of performances, and others, may be attained through the many possible embodiments of the present invention.

Pump system 20 is mainly comprised of a spindle-motor 30, a cap 50, a body 60, a base 70, and an impeller 40. Overall dimensions of the preferred embodiment of FIG. 1 are roughly 2 inches wide, 2 inches long, and 1 inch tall. Each of the components of system 20 may be made from any commonly known material or process, including aluminum, die cast metals, molded plastic, and the such. If plastic is to be used in contact with the cooling fluid Fluorinert (a trademark of 3M) it is preferred that polyethylene-terephthalate (PET) be used.

Spindle-motor 30 is a commercially available DC brushless spindle motor as used with computer hard drives. Hard drive spindle-motors are typically available in the range of less than one-fifth horsepower. U.S. Pat. No. 5,006,943; U.S. Pat. No. 5,402,023; U.S. Pat. No. 6,543,781; and U.S. Pat. No. 5,942,820 all describe the construction and function of hard drive type spindle-motors applicable to the present invention, and are herein incorporated by reference to this application. Generally, DC brushless spindle-motor 30 is comprised of a stationary shaft 31 having high precision magnetic bearings which rotatably support an outer hub 32. One or both of ends of hub 32 may contain a magnetic seal which isolates the insides of spindle-motor 30 from the outside atmosphere. Typically, the magnetic seals will include a magnetic fluid for increased sealablity. Rare-earth magnets in combination with a controller and a stator assembly provide the means of rotating hub 32 around the stationary shaft according to well know electric motor principles. The rare-earth magnets contained within spindle-motor 30, typically constructed from neodymium-iron-boron or samarium-cobalt, provide a higher magnetic flux than alnico or ferrite permanent magnets common to standard DC brushless motors. The rare-earth magnets provide the means of faster motor start ups, faster rotations, more reliable performance and more compact systems, in comparison to standard DC brushless motors. With spindle-motors, such as spindle-motor 30 shown herein, hub 32 is provided in a fashion that allows it to be mounted to the disk like "platters" of a hard drive, very similar to the mounting of impeller 40 of the present invention. Because the exact configuration and construction of DC brushless spindle-motor 30 is not central to the present invention, hereinafter spindle-motor 30 will be described in general terms as warranted for a person skilled in the art to understand and appreciate the present invention. The attached drawings show only the features of spindle-motor 30 necessary to practice the invention.

Significant efforts have been expended in the development and progress of rare-earth spindle motors which make them ideal for liquid cooling pumps. First, because of the mass production rates associated with hard drives, spindle-motor 30 is available at low costs. Second, spindle-motor 30 is highly balanced and does not contain any significant wear parts resulting in very reliable performance. In fact, spindle-motor 30 is commonly available with average mean times between failures (MTBF's) in the range of 800,000 hours. Third, spindle-motor 30 is capable of fast rotational speeds. Rare-earth magnets within spindle-motor 30 provide the means of allowing hub 32 to achieve speeds ranging from 3600 rotations per minute, typical of laptops hard drives, to over 15,000 rpm's, as typical of high performance SCSI hard drives motors. Large rpm's allow the size of pump system 20 to be minimized. Fourth, the output power of hard drive spindle-motors coincide with the cooling needs of many electronic components. Fifth, because hard-drive motors are compact and well balanced they are efficient in creating their output. Efficiency is a desirable feature of liquid cooling systems.

Figure 7:
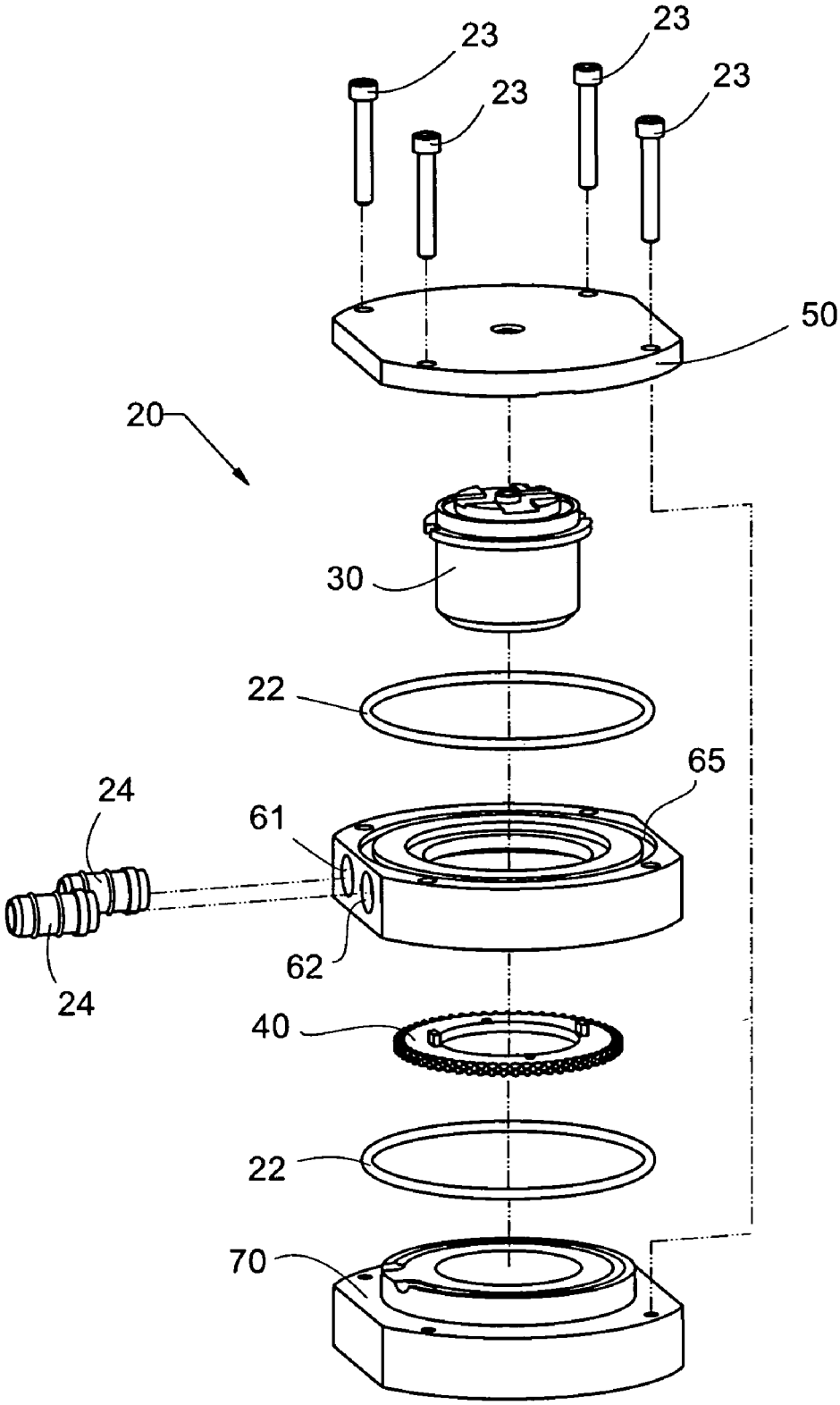
FIG. 7 is an exploded perspective view of the pump of FIG. 1.

Referring back to FIG. 1, body 60 is sandwiched between cap 50 and base 70. A plurality of screws 23 hold the assembly together by passing through mounting holes of cap 50, and screw holes 63 of body 60, and into a plurality of screw threads 72 of base 70 (the assembly can be best seen by FIG. 7). The top surface of body 60 has a cap seal groove 65 and the bottom surface of body 60 has a base seal grove 66. Seal grooves 65 and 66 each work with an o-ring 22 for sealing a closed cavity created between cap 50, body 60 and base 70. O-ring 22 has a cross-sectional diameter of 0.0875 inches, an outside diameter of 2 inches, and is made from Viton (a trademark of Dupont). Grooves 65 and 66 are 0.095 inches wide, 0.051 inches tall and start 0.921 inches from the center axis of base 70. Although o-ring 22 of the present invention is made from Viton (a trademark of Dupont), as to be compatible with the cooling fluid Fluorinert (a trademark of 3M), o-ring 22 can be made from other materials compatible with the chosen fluid to be pumped.

Figure 3:
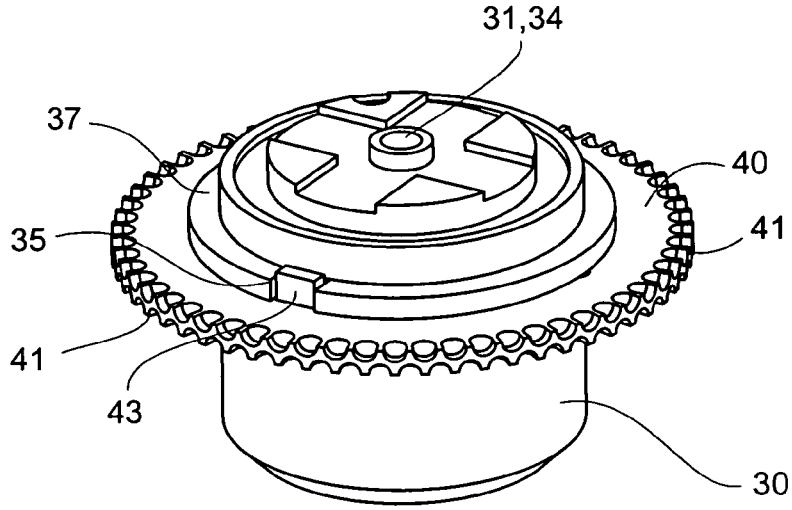
FIG. 3 is a perspective view of the assembly of an impeller to a spindle motor, according to the present invention.

Within the cavity created by cap 50, body 60 and base 70, is spindle-motor 30 and an impeller 40. Spindle-motor 30 may be secured to the assembly in multiple ways depending on the chosen motor type and manufacturer. A first securing method utilizes the input connector 33, which supplies electrical energy to the stator assembly. Input connector 33 may contain exterior threads that engage with interior threads of a ring 36. Another method of securing spindle-motor 30 to pump assembly 20 is through the use of a mounting thread 34 contained within stationary spindle 31 (FIG. 3). A motor screw (not shown) is placed through a mounting hole 51 of cap 50, and into mounting thread 34.

Both securing methods fix stationary shaft 31 and allow for the rotation of hub 32. Either, or both, securing methods are acceptable and because they are driven by spindle-motor manufacturers, other methods may be used within the spirit of the present invention.

Best shown by FIG. 3, attached to hub 32 is impeller 40 which is preferably a turbine type. Impeller 40 according the preferred embodiment is 0.07 inches thick, has an inner diameter of 0.975 inches, and an outside diameter of 1.554 inches. Other designs and dimensions are possible following well known pump design guides. Impeller 40 coaxially fastens to the exterior surfaces of hub 30 by the engagement of posts 42 with recesses 35, located in hub 32. The combination of posts 43 with recesses 35 constrain impeller 40 rotationally, but allow it to float axially. The ability to mount impeller 40 directly to the exterior of hub 32 allows pump system 20 to take up less space than prior art DC brushless motor systems. Again, these interconnecting features may change depending upon the commercial source of spindle-motor 30 and the mounting features therein provided. With the preferred embodiment, posts 43 are 0.80 inches tall by 0.12 inches wide by 0.05 inches deep, and engage with recesses 35 that are 0.14 inches wide by 0.076 inches deep.

Figure 4:
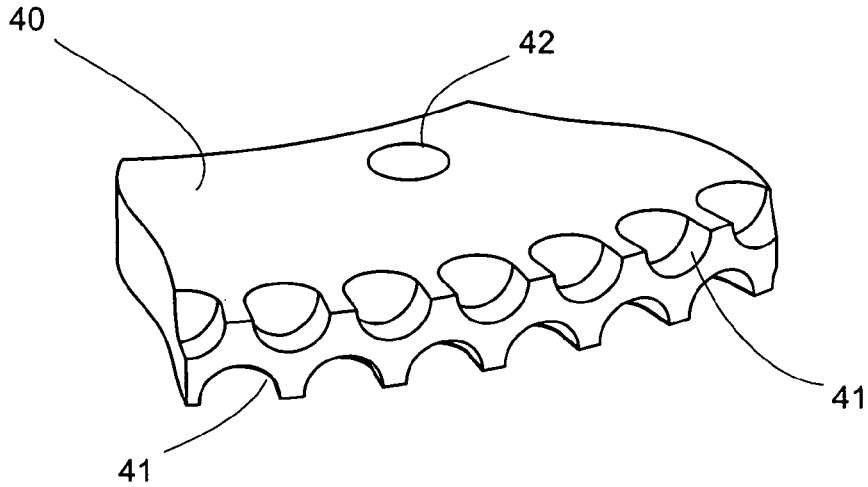
FIG. 4 is a partial perspective view of a turbine impeller including a plurality of impeller vanes, also shown is a fluid pressure equalization hole.
Figure 5:
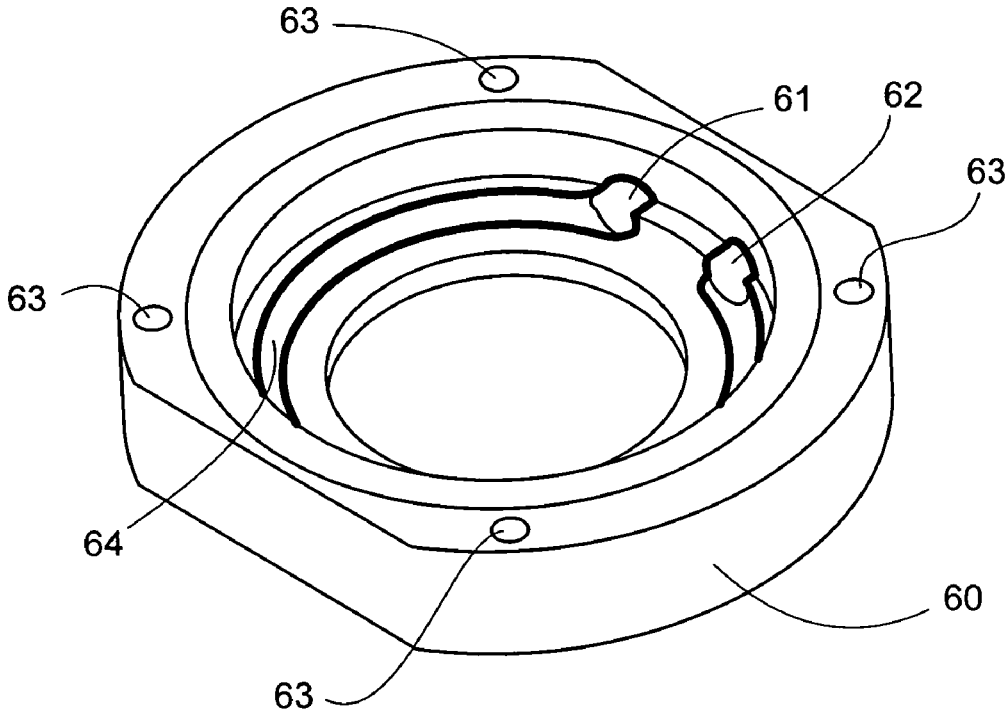
FIG. 5 is a perspective view of a pump body having a fluid channel (shown with bolded lines for clarity)
Figure 6:
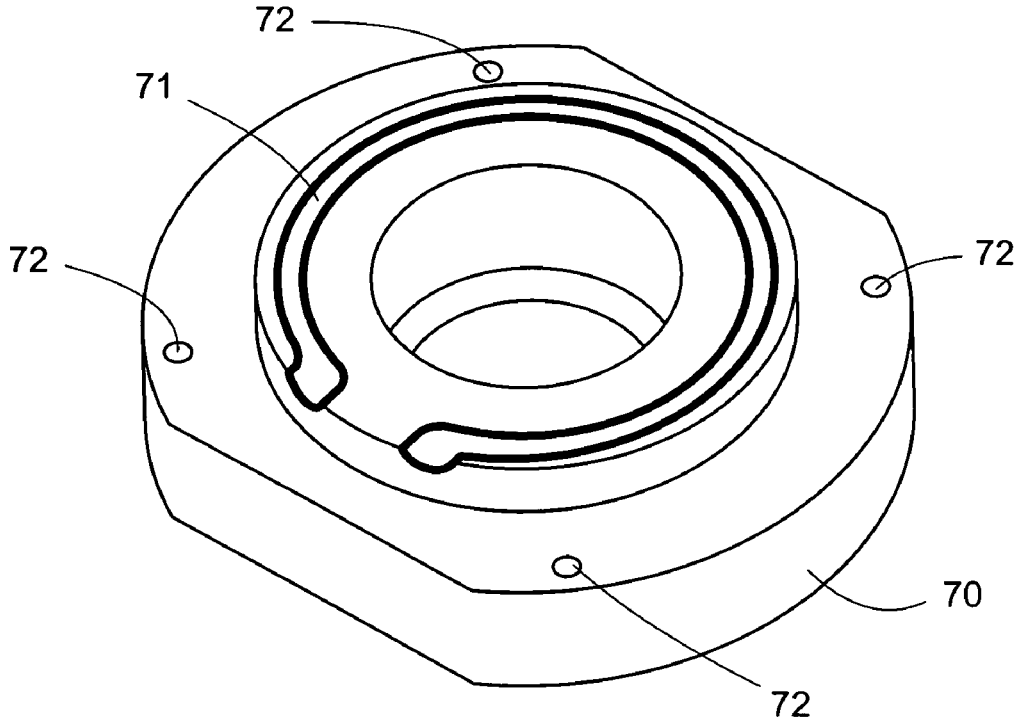
FIG. 6 is a perspective view of a pump base having a fluid channel (shown with bolded lines for clarity), wherein the body fluid channel of FIG. 5 and the base fluid channel of FIG. 6 form a fluid cavity.

The rotational constraint of impeller 40 to hub 32 of spindle-motor 30 provides the means for moving impeller 40 with angular velocities over 3600 rpm's. As shown in FIG. 4, both sides of impeller 40 contain a radial array of turbine vanes 41. Vanes 41 are offset from the top side to the bottom side for a more consistent loading of spindle-motor 30. According to the preferred embodiment, each of vanes 41 are 0.0625 inches wide, by 0.625 inches deep and spherical in construction. Impeller 40 rotates through a fluid cavity created by a body fluid channel 64 and a base fluid channel 71, highlighted by FIG. 5 and FIG. 6. In the case of the preferred embodiment, the fluid cavity has dimensions of 0.08 inches wide and protrudes 0.025 inches above vanes 41 of impeller 40. There is a 0.0005 to 0.004 inch clearance between impeller 40 and body 60 and base 70. This clearance allows fluid to fill the gap and lubricate the motion of impeller 40. A plurality of fluid bypass holes 42 allow for fluid pressures to equalize between the two sides of impeller 40. Furthermore, the interaction between posts 43 and recesses 35 allow impeller 40 to float within the fluid cavity, resulting in low friction and high efficiencies.

Body 60 has a first fluid fitting orifice 61 and a second fluid fitting orifice 62 each connected to the fluid cavity. Depending upon the rotational direction of spindle-motor 30, and the resulting rotational direction of impeller 40, the plurality of vanes 41 draw fluid in through first fluid fitting orifice 61 and push the fluid out second fluid fitting orifice 62, or vice-versa. Connected to both first orifice 61 and second orifice 62 are a fluid fitting 24. Although fluid fitting 24 is shown as a press-on barbed fitting, a number of widely known fittings may be employed including "quick-disconnect" fittings.

Figure 10:
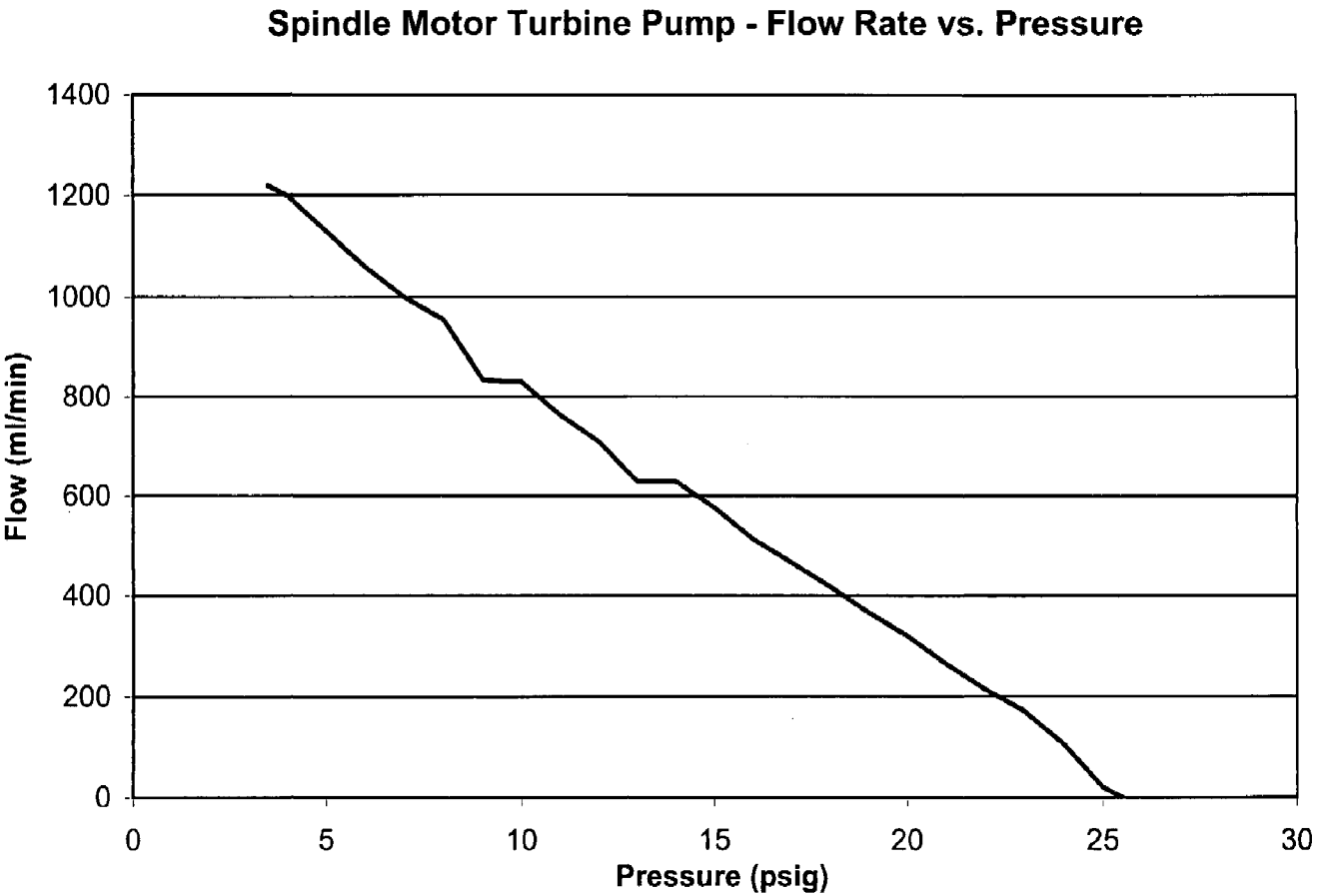
FIG. 10 is a plot showing the flow rate versus pressure performance of the pump of FIG. 1.

Pump performance characteristics, such as pressure and flow rates, are largely driven by the design of impeller 40. The diameter and speed of impeller 40 determine the tangential velocity of vanes 41. The tangential velocity of vanes 41 contribute to determining the resulting pressure and flow rate of pump system 20. For a given application that requires a particular pump performance and a resulting tangential speed of vanes 41, the large rpm's of spindle-motor 30, created by its at least one rare-earth magnet, provides the means of minimizing the diameter of impeller 40 and the overall package size of system 20. FIG. 10 provides test data correlating flow rate versus pressure for the compact preferred embodiment described herein.

Additional benefits come from using spindle-motor 30 within pump system 20. One such benefit is that the dielectric fluid commonly used as a liquid coolant further improves the performance of spindle-motor 30 in comparison to its use with hard drives. As previously described, spindle-motor 30 may contain a magnetic fluid for improved sealiblity. Although this feature is needed for disk drive applications, as to keep contaminants away from the sensitive magnetic memory disks, this feature is not needed for liquid cooling. In fact, with the addition of the dielectric fluid into the present invention, the less viscous cooling fluid displaces the magnetic fluid and results in less friction acting against spindle-motor 30. Pump system 20, according to the present invention, is figured to be 8% efficient. In addition, it has been shown that the cooling fluid provides cooling of spindle-motor 30 which may increase its life and reliability.

The use of pump system 20 is typical of pumping systems. Preferably a common "sensorless" hard drive motor control system delivers power to a series of input pins of connector 33 which correspond to a plurality of groups of coils within spindle-motor 30. Depending upon the size of motor 30 and the desired speed, input powers can typically be between 5 and 12 volts, and with a current of one-half to 3 amperes. The input power is transferred into a magnetic field which causes hub 32 to rotate according to well known electric motor practice. The rotation of hub 32 causes impeller 40 to rotate which results in movement of vanes 41. Vanes 41 draw a supply of low pressure fluid and transform it into a higher pressure supply of fluid. The flow of fluid is directed by connecting tubes to fittings 24.

Figure 8:
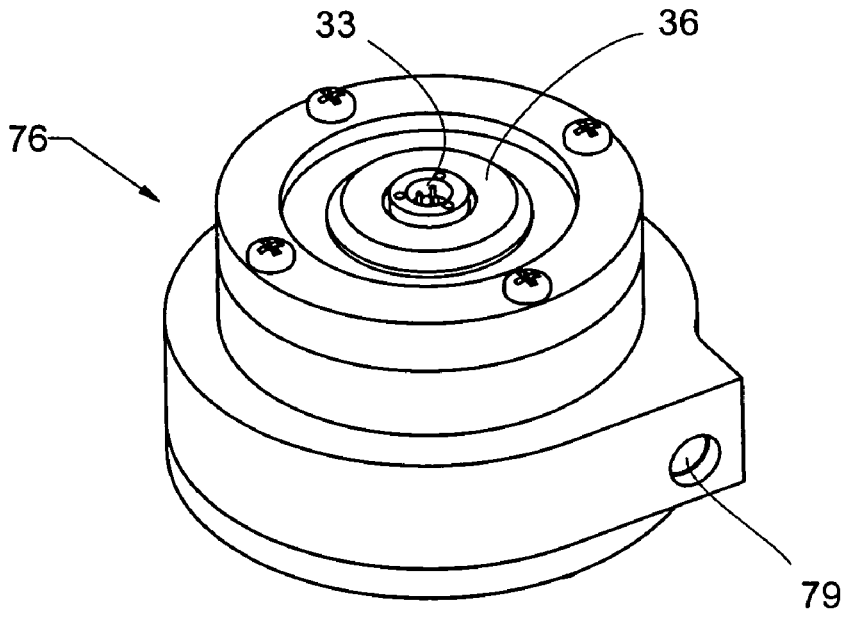
FIG. 8 is a top perspective view of an alternative embodiment centrifugal pump.
Figure 9:
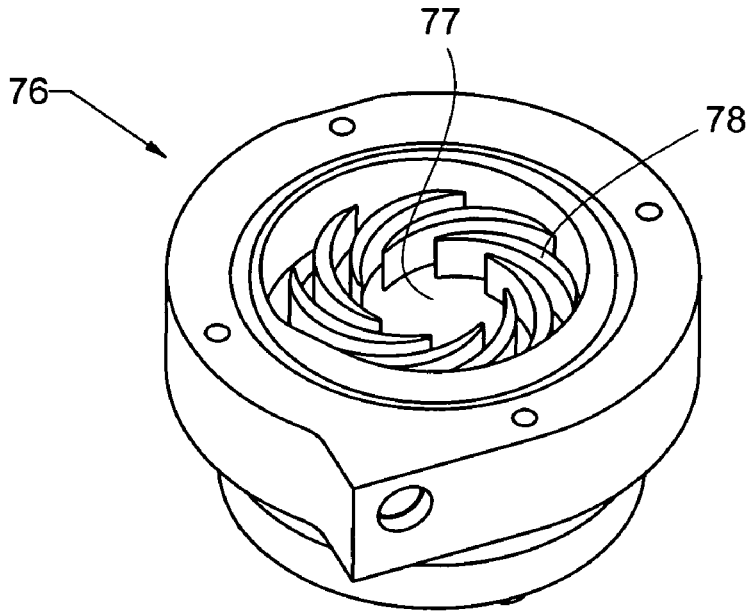
FIG. 9 is a bottom perspective view of the alternative embodiment shown in FIG. 8 and with the bottom cover removed for visibility of the centrifugal impeller and vanes.

Other embodiments of the present invention are possible. One such embodiment is shown in FIG. 8 and FIG. 9 wherein a centrifugal pump system 76 is shown. This embodiment employs and gains the advantages of spindle-motor 30, but rather than using turbine impeller 40, this embodiment utilizes a centrifugal impeller 77 that contains a series of centrifugal vanes 78. Fluid enters through an inlet directed at the central axis of centrifugal impeller 77 (not shown) and is pressurized through the radial forces created by centrifugal vanes 78, according to well known centrifugal pump operation. The pressurized fluid is dispensed through exit 79. This centrifugal embodiment version of the present invention produces higher flow rates, but at a reduced pressure, than the turbine embodiment. Although the turbine version is preferred for use with spray cooling, the centrifugal version may be desirable in other pumping applications. Positive displacement gear pumps may also be desirable in certain applications. The present invention is not limited to any one known pumping method. With any pumping method, and according to the present invention, it is highly desirable to design the pumping method to be integrated with the well adopted, highly reliable, high RPM, and low cost spindle-motor 30.

While the low spindle motor driven pump herein described constitute preferred embodiments of the invention, it is to be understood that the invention is not limited to these precise form of assemblies, and that changes may be made therein with out departing from the scope and spirit of the invention.

ELEMENTS BY REFERENCE NUMBER

| # | NAME |
|---|---|
| 20 | Pump System |
| 21 | |
| 22 | O-ring |
| 23 | Screw |
| 24 | Fluid Fitting |
| 25 | |
| 26 | |
| 27 | |
| 28 | |
| 29 | |
| 30 | Spindle Motor |
| 31 | Stationary Spindle |
| 32 | Hub |
| 33 | Connector |
| 34 | Mounting Thread |
| 35 | Recesses |
| 36 | Ring |
| 37 | |
| 38 | |
| 39 | |
| 40 | Impeller |
| 41 | Turbine Vanes |
| 42 | Fluid Bypass Holes |
| 43 | Impeller Posts |
| 44 | |
| 45 | |
| 46 | |
| 47 | |
| 48 | |
| 49 | |
| 50 | Cap |
| 51 | Mounting Hole |
| 52 | |
| 53 | |
| 54 | |
| 55 | |
| 56 | |
| 57 | |
| 58 | |
| 59 | |
| 60 | Body |
| 61 | First Fluid Fitting Orifice |
| 62 | Second Fluid Fitting Orifice |
| 63 | Screw Holes |
| 64 | Body Fluid Channel |
| 65 | Cap Seal Groove |
| 66 | Base Seal Groove |
| 67 | |
| 68 | |
| 69 | |
| 70 | Base |
| 71 | Base Fluid Channel |
| 72 | Screw Threads |
| 73 | |
| 74 | |
| 75 | |
| 76 | Centrifugal Pump System |
| 77 | Centrifugal Impeller |
| 78 | Centrifugal Vanes |
| 79 | Exit |

I claim:

1. A liquid pump for use with an electronic component cooling system comprising:

a housing;

a DC brushless spindle-motor mounted to said housing, said motor comprising an at least one rare-earth magnet for rotating an outer hub around a stationary shaft;

an impeller rotationally constrained to said hub, said impeller contained within said housing;

said housing having a fluid inlet for receiving a supply of lower pressure fluid and for delivering said supply of lower pressure fluid to said impeller, wherein rotation of said impeller transforms said supply of lower pressure fluid to a supply of higher pressure fluid; and said housing having a fluid exit for dispensing said supply of higher pressure fluid.

2. The liquid pump of claim 1, wherein said impeller may axially float in relation to said hub.

3. The liquid pump of claim 1, wherein said impeller is a centrifugal impeller.

4. The liquid pump of claim 1, wherein said impeller is a turbine impeller.

5. The liquid pump of claim 1, wherein said at least one rare-earth magnet is made from neodymium-iron-boron.

6. The liquid pump of claim 1, wherein said at least one rare-earth magnet is made from samarium-cobalt.

7. The liquid pump of claim 1, wherein said spindle-motor is capable of speeds over 3600 rotations per minute.

8. The liquid pump of claim 1, wherein said spindle-motor has an output less than ⅕ horsepower.

9. The liquid pump of claim 1, wherein said spindle-motor creates less than 2000 milliliters per minute of flow.

10. The liquid pump of claim 1, wherein said spindle-motor contains at least one magnetic seal between said stationary shaft and said hub.

11. The liquid pump of claim 1, wherein said spindle-motor contains a magnetic bearing.

12. A fluid pump for use within a liquid cooling system comprising:

an enclosure;

a DC brushless motor comprised of a stationary spindle, an at least one rare-earth magnet, and a hub for rotating about said stationary spindle, said stationary spindle fixed to said enclosure;

an impeller disk rotatably constrained to said hub of said motor;

said enclosure for housing said impeller disk including an inlet for providing a low pressure supply of fluid to said impeller disk;

wherein rotation of said impeller disk transforms said low pressure supply of fluid to a higher pressure supply of fluid; and an exit in said housing for discharging said supply of higher pressure fluid.

13. The fluid pump of claim 12, wherein said inlet is fluidly connected to a liquid thermal management unit.

14. The fluid pump of claim 12, wherein said liquid cooling system is a spray cooling liquid cooling system.

15. The fluid pump of claim 12, wherein said exit is fluidly connected to a heat exchanger of said liquid cooling system.

16. The fluid pump of claim 12, wherein said impeller disk is a centrifugal impeller.

17. The fluid pump of claim 12, wherein said impeller disk is a turbine impeller.

18. The fluid pump of claim 12, wherein said at least one rare-earth magnet is constructed from neodymium-iron-boron.

19. The fluid pump of claim 12, wherein said at least one rare-earth magnet is constructed from samarium-cobalt.

20. The fluid pump of claim 12, wherein said spindle-motor is capable of speeds over 3600 rotations per minute.

21. The fluid pump of claim 12, wherein said spindle-motor contains at least one magnetic seal.

22. The fluid pump of claim 21, wherein said at least one magnetic seal contains a dielectric cooling fluid used with said liquid cooling system.

23. The fluid pump of claim 12, wherein said spindle-motor contains a magnetic bearing.

24. The fluid pump of claim 12, wherein said spindle-motor has an output less than ⅕ horsepower.

25. The fluid pump of claim 12, wherein said spindle-motor creates less than 2000 milliliters per minute of flow.

* * * * *